US007150360B2

(12) United States Patent
Carlin et al.

(10) Patent No.: US 7,150,360 B2
(45) Date of Patent: Dec. 19, 2006

(54) MODULAR DISPLAY PLATFORM

(76) Inventors: Glenn Carlin, 391 Kent Cornwall Rd., Kent, CT (US) 06757; Gilbert Aviles, 67 Lang Rd., Accord, NY (US) 12404

( * ) Notice: Subject to any disclaimer, the term of this patent is extended or adjusted under 35 U.S.C. 154(b) by 412 days.

(21) Appl. No.: 10/729,534

(22) Filed: Dec. 5, 2003

(65) Prior Publication Data

US 2004/0195191 A1 Oct. 7, 2004

Related U.S. Application Data

(60) Provisional application No. 60/459,597, filed on Apr. 2, 2003.

(51) Int. Cl.
*A47G 19/08* (2006.01)

(52) U.S. Cl. ..... 211/49.1

(58) Field of Classification Search ..... 211/49.1, 211/74, 85.18, 126.7, 194
See application file for complete search history.

(56) References Cited

U.S. PATENT DOCUMENTS 3,442,378 A * 5/1969 Wolfe ..... 206/459.5
4,735,321 A * 4/1988 Day ..... 206/597
4,750,623 A * 6/1988 Flum ..... 211/59.4
4,801,024 A * 1/1989 Flum et al. ..... 211/59.4
4,865,202 A * 9/1989 Day ..... 206/597
5,016,761 A * 5/1991 Stoddard et al. ..... 211/59.4
5,221,002 A * 6/1993 Garganese ..... 206/151
5,285,907 A * 2/1994 Franchere et al. ..... 211/74
5,514,343 A * 5/1996 Verwohlt et al. ..... 422/104
5,819,940 A * 10/1998 Roulin et al. ..... 206/531
6,164,448 A * 12/2000 Schmutz et al. ..... 206/488
6,971,518 B1 * 12/2005 Lowry ..... 206/386
7,066,330 B1 * 6/2006 Lashley ..... 206/480

* cited by examiner

*Primary Examiner*—Sarah Purol
(74) *Attorney, Agent, or Firm*—McCormick, Paulding & Huber LLP

(57) ABSTRACT

A modular display platform comprises at least two sections of the same shape. Each section is fixedly disposed next to an adjacent section in staggered relationship such that a perimeter sections form a stepped pattern for facilitating the abutting and interlocking of additional platforms thereat. The sections form a support surface for products disposed thereon. A sidewall is disposed generally along at least a portion of the perimeter and has an edge for engaging an external mounting surface. The support surface and the sidewall cooperate to define a recess. At least one standoff is disposed within the recess and has a surface extending in a direction generally parallel to that of the sidewall from a proximal end adjacent to the support surface to a distal end for engaging the external surface in order to strengthen the support surface at locations inwardly of the perimeter.

19 Claims, 9 Drawing Sheets

MODULAR DISPLAY PLATFORM

CROSS REFERENCE TO RELATED APPLICATION

This application claims the benefit of U.S. Provisional Application Ser. No. 60/459,597 filed on Apr. 2, 2003 entitled "Modular Display Platform", the disclosure of which is incorporated by reference herein in its entirety.

FIELD OF THE INVENTION

This invention relates generally to platforms for supporting and displaying products, and more particularly to modular platforms that can be abutted with one another in various permutations to provide a display of products that cooperate to form numerous three dimensional patterns or shapes.

BACKGROUND OF THE INVENTION

Platforms supporting and displaying products for purchase are well-known. Such platforms can serve several purposes. For example, one purpose is to provide a slight space between the products and the floor in order to minimize water damage should the floor become wet or to enable air to circulate beneath the products. Another purpose is to dispose the products at an elevated position closer to eye level for enhanced visibility.

A drawback with prior platforms is that such platforms can be extremely heavy and therefore difficult to move. Prior platforms, such as wooden crate platforms, can be an eye sore as well as dangerous to handle because of rough surfaces that can release splinters. Such platforms are typically square or rectangular, and require additional components to interlock adjacent platforms together in order to enhance stability to the overall structure. Further, prior platforms that are significantly larger than the products stacked thereon can be wasteful in consuming floor space when not completely covered with products. Accordingly, it is a general object of the present invention to overcome the above-identified drawbacks of prior display platforms.

SUMMARY OF THE INVENTION

A modular display platform comprises at least two sections of substantially the same shape for supporting products such as, for example boxes or crates holding cans of beverages such as soda or beer. More specifically, the number of sections can range, for example, from two to ten. The sections are preferably fabricated from a material including high density polyethylene (HPDE) such as HPDE injection molded plastic. The sections are preferably rectangular and integrally molded with one another to form a unitary structure. Each section is fixedly disposed next to at least one adjacent section in staggered relationship such that a perimeter of the at least two sections cooperate to form a stepped pattern for facilitating the abutting and interlocking of additional platforms at the perimeter. The at least two sections cooperate to include a support surface for products disposed thereon and extends generally over an area bounded by the perimeter. In a preferred embodiment, each section has a width of about 10 inches, a length of about 19 inches, and a height of about 3 inches. Moreover, each section is preferably offset from an adjacent segment by about 4.75 inches in a direction along a length of the sections.

A sidewall is disposed generally along at least a portion of the perimeter and extends in a direction generally transverse to that of the support surface from a proximal end adjacent to the support surface to a distal end having an edge for engaging an external mounting surface. In a preferred embodiment, the sidewall is disposed substantially along the entire perimeter. The support surface and the sidewall cooperate to define a recess in order to reduce the overall weight and cost of the platform.

At least one standoff is disposed within the recess and has a surface extending in a direction generally parallel to that of the sidewall from a proximal end adjacent to the support surface to a distal end for engaging the external surface in order to strengthen the support surface at locations inwardly of the perimeter. In a preferred embodiment, the surface of the standoffs are generally cylindrical and define a generally hollow interior in order to minimize the additional weight and cost of the platform as a result of providing the standoffs.

DETAILED DESCRIPTION OF THE PREFERRED EMBODIMENTS

Figure 1A:
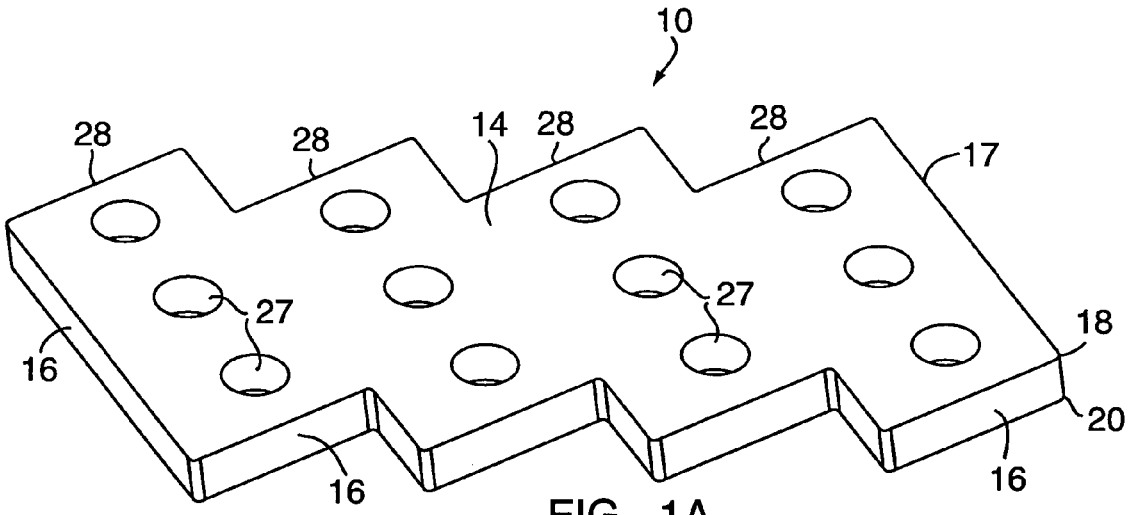
FIG. 1A is a perspective view of a modular display platform embodying the present invention.

With reference to FIGS. 1A–1E, a modular display platform embodying the present invention is designated generally by the reference number 10. The platform 10 is made of a strong and durable material for supporting several stackable layers of boxes and/or crates. Preferably, the platform 10 includes a high density polyethylene (HPDE) in the form of injection molded plastic. However, other strong and durable plastics or other materials may be substituted without departing from the scope of the present invention.

The modular display platform 10 indudes a support surface 14, and one or more sidewalls 16, 16 depending from at least a portion of a perimeter 17 of the support surface. The sidewalls 16, 16 may be used to provide advertisements for products such as those to be displayed on the platform 10. The one or more sidewalls 16, 16 each extend from a proximal end 18 of the sidewall adjacent to the support surface 14 to a distal end 20 of the sidewall at an underside of the platform 10 or side opposing the support surface for engaging an external floor or other surface. Preferably, as shown in the figures, the sidewalls 16, 16 depend from generally the entire perimeter of the support surface to provide strength to the platform 10.

An underside of the platform 10 or side opposing the support surface 14 is preferably generally open-ended such that the distal end 20 of the sidewalls 16, 16 serve to bear the weight of the platform and products to be supported on the platform. In other words, the support surface 14 and the sidewalls 16, 16 cooperate to define a recess or open-ended structure on the underside of the platform 10. The open-ended structure provides a lightweight and inexpensive platform relative to either a solid or hollow platform including a substantial floor surface.

Figure 1B:
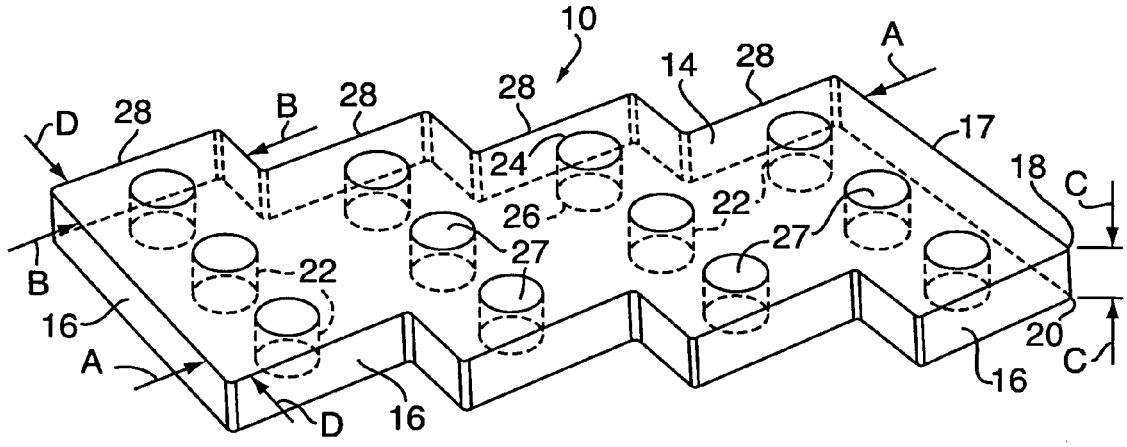
FIG. 1B is a perspective view of the modular display platform of FIG. 1A with the support surface removed.

The platform 10 preferably defines a plurality of projections or standoffs 22, 22 disposed within the recess and depending from the support surface 14 inwardly of and generally in the same direction as the one or more sidewalls 16, 16. More specifically, the standoffs 22, 22 each extend from a proximal end 24 of the standoff adjacent to the support surface 14 to a distal end 26 of the standoff at the underside of the platform 10 or side opposing the support surface for engaging an external floor or other surface to assist the distal ends 20 of the sidewalls 16, 16 in bearing the weight of the platform and products supported thereon. The standoffs 22, 22 provide structural integrity to the platform 10 to prevent the support surface 14 from sagging, collapsing or otherwise failing under the weight of several stackable layers of products supported thereon. As shown in FIG. 1B, the standoffs 22, 22 depending from the support surface 14 are generally cylindrical, but may be rectangular, square or other shapes without departing from the scope of the present invention. Moreover, the standoffs 22, 22 may include a floor or be substantially or partially open-ended at the distal end 26. As shown in the figures, the support surface 14 defines openings 27, 27 exposing a generally hollow interior defined by the standoffs 22, 22. Alternatively, the standoffs 22, 22 can be covered by the support surface 14.

As shown in the figures, the perimeter 17 of the platform 10 has a generally repeatable stepped or zigzagged shape that facilitates the abutting or interlocking together of a plurality of platforms to form an almost endless variety of configurations for visually enhancing the display of products supported on the platforms. More specifically, the perimeter 17 of each platform 10 generally takes the overall form of a plurality of repeatable shapes or sections that are located in side-by-side and slightly staggered relationship to one another. Preferably, the repeatable shapes or sections are rectangles. As shown in FIGS. 1A–1E, for example, the platform 10 defines a perimeter 17 that generally takes the overall form of a plurality of four rectangles or sections 28 located in side-by-side and slightly staggered relationship to one another. Preferably, each platform 10 is a unitary structure. However, each of the repeatable shapes or sections 28 cooperating to provide the overall form of the platform 10 can be separate units that are coupled together either releasably or permanently without departing from the scope of the present invention. Moreover, although the repeatable shapes or sections being illustrated are in the form of staggered rectangles, it should be understood that any repeatable shape that permits abutting or interlocking of platforms together is within the scope of the present invention.

Figure 1C:
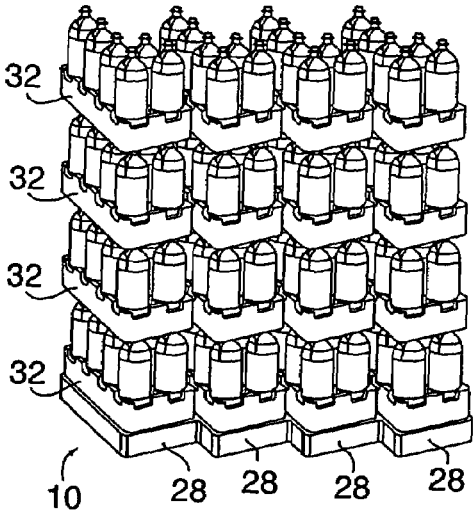
FIG. 1C is a perspective view of a visual display resulting from stacking crates of two-liter beverages on the modular display platform of FIG. 1A.

The modular display platform 10 is especially suited for supporting and displaying products for sale such as, for example, beverages either packaged in boxes or openly displayed in crates. For example, each of the sections 28 generally in the form of a rectangle is ideally shaped for accommodating rectangular boxes or cases 30, 30 holding cans of beverages such as soda or beer as shown in FIG. 1D, or rectangular crates 32, 32 for openly holding two liter bottles of beverages as shown in FIG. 1C, or a combination of cases and crates as shown in FIG. 1E.

Preferably, each section 28 of the platform 10 is sized and shaped to accommodate two cases or "fridge packs" wherein each fridge pack is sized to be two 12 oz. beverage cans wide by six 12 oz. cans deep. Moreover each section 28 is sized and shaped to accommodate standard industry injection molded two liter crates or trays that hold 8 two liter beverage bottles. In a preferred embodiment, as shown in FIG. 1B, the width A of the platform 10 is about 40 inches; the width B of each section 28 is about 10 inches; the height C of the platform 10 is about 3 inches; the length or depth D of each section is about 19 inches, and the overall length or depth of the platform is about 33.25 inches for accommodating fridge packs and two liter crates.

Figure 1E:
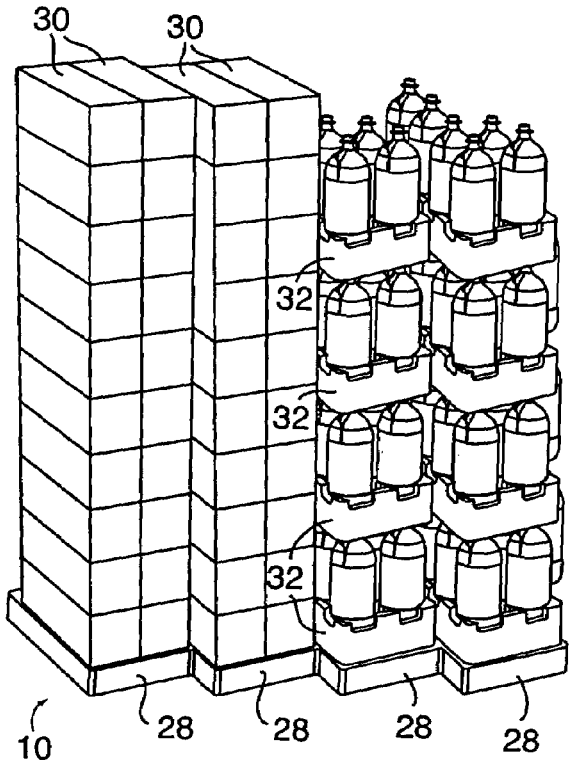
FIG. 1E is a perspective view of the visual display resulting from stacking a combination of crates and boxes on the modular display platform of FIG. 1A.
Figure 1D:
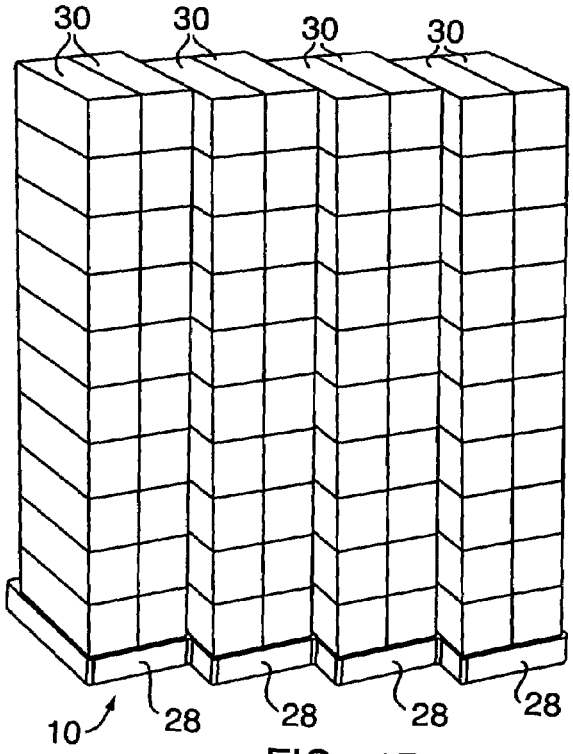
FIG. 1D is a perspective view of the visual display resulting from stacking boxes containing cans of beverage on the modular display platform of FIG. 1A.

Each platform 10 preferably accommodates up to about 80 fridge packs or 30 conventional cases 30, 30 of soda (see FIG. 1D), or up to about 128 two liter bottle crates 32, 32 wherein each section 28 can hold up to about 4 stackable layers of crates (see FIG. 1C), or a combination of cases and crates (see FIG. 1E).

In operation, the perimeter 17 of a plurality of platforms 10 can be abutted or interlocked together in an almost endless variety of ways to form various multiple platform configurations for visually enhancing the display of products supported on the platforms. Moreover, no additional parts are needed to couple adjacent platforms together. The different zigzag configurations of the displayed items resulting from abutting and interlocking the platforms in a variety of ways produces what is called the "dissolve effect". Consumers first see the graphic panel that is angled directly towards them. Then out of their peripheral vision they catch the next panel towards their side. This can stop them in their tracks and can make them take a step or two back just so that they do not think they have missed anything. An offset of about 4.75 inches per section accommodates an exact full bottle view when two liter trays are stored on the platforms.

Figure 2A:
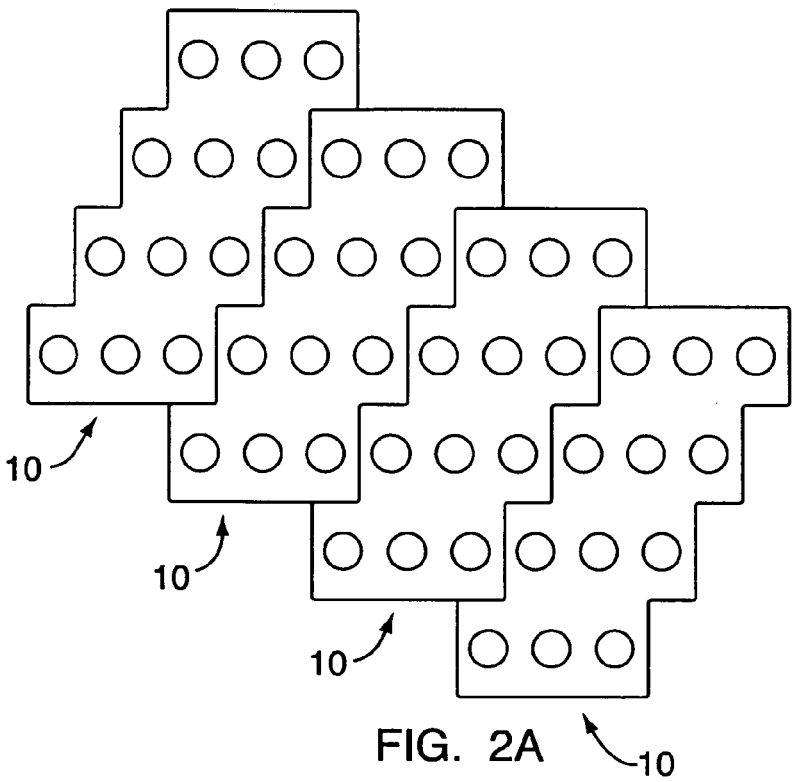
FIG. 2A is a top plan view schematically illustrating an overall shape of abutting together four modular display platforms.
Figure 2B:
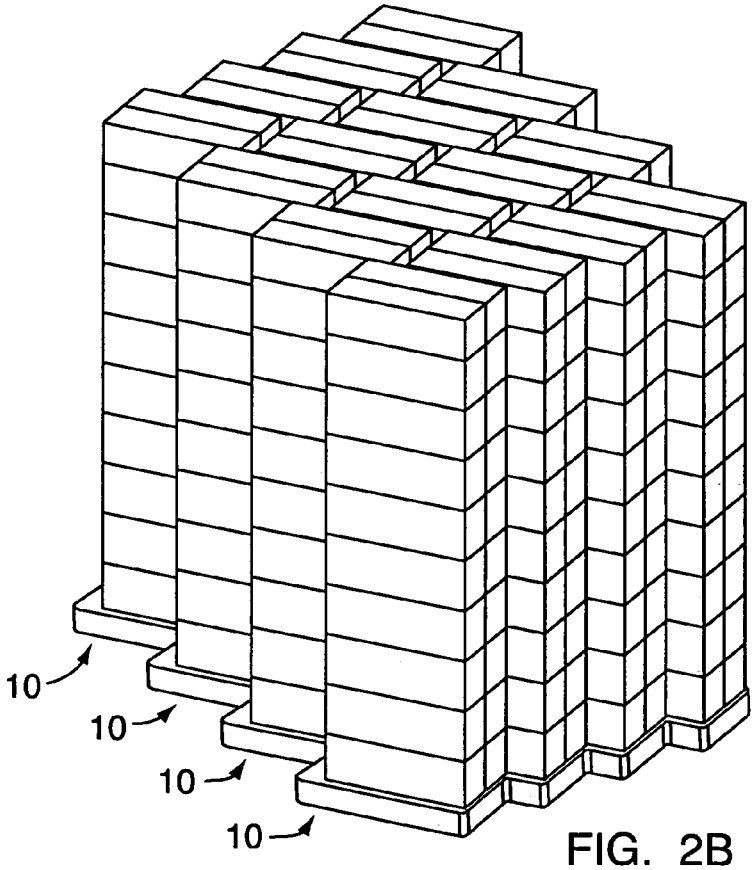
FIG. 2B is a perspective view of a visual display resulting from stacking boxes on the modular display platforms abutted together a shown in FIG. 2A.
Figure 3A:
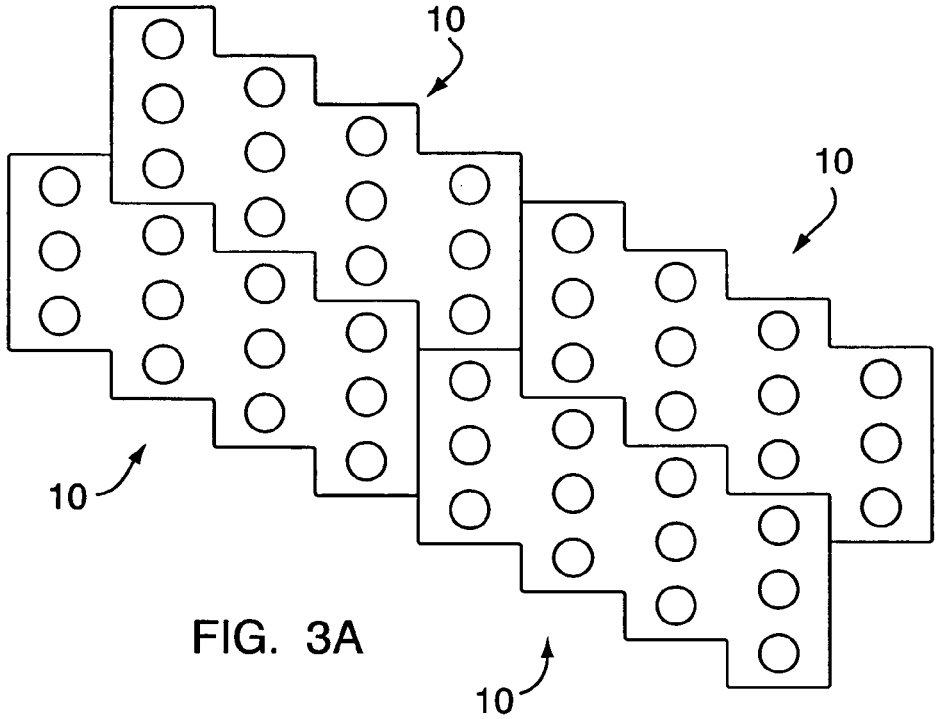
FIG. 3A is a top plan view schematically illustrating another overall shape of abutting together four modular display platforms.
Figure 3B:
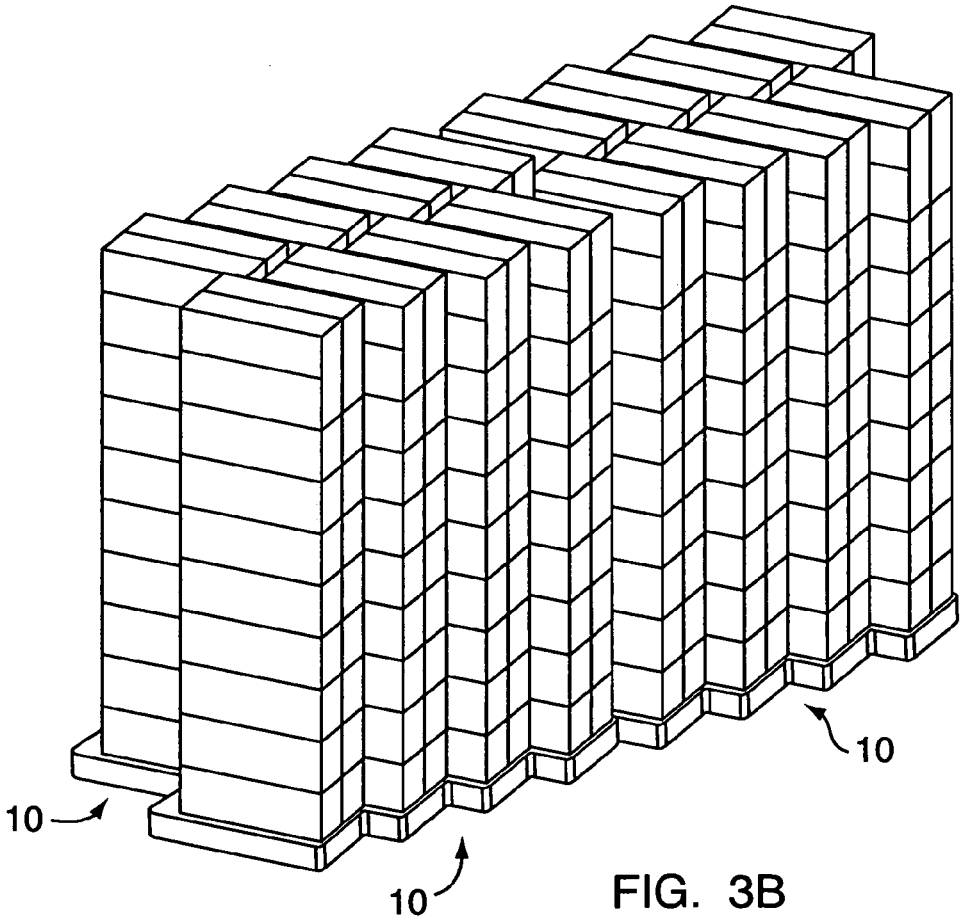
FIG. 3B is a perspective view of a visual display resulting from stacking boxes on the modular display platforms abutted together a shown in FIG. 3A.
Figure 4A:
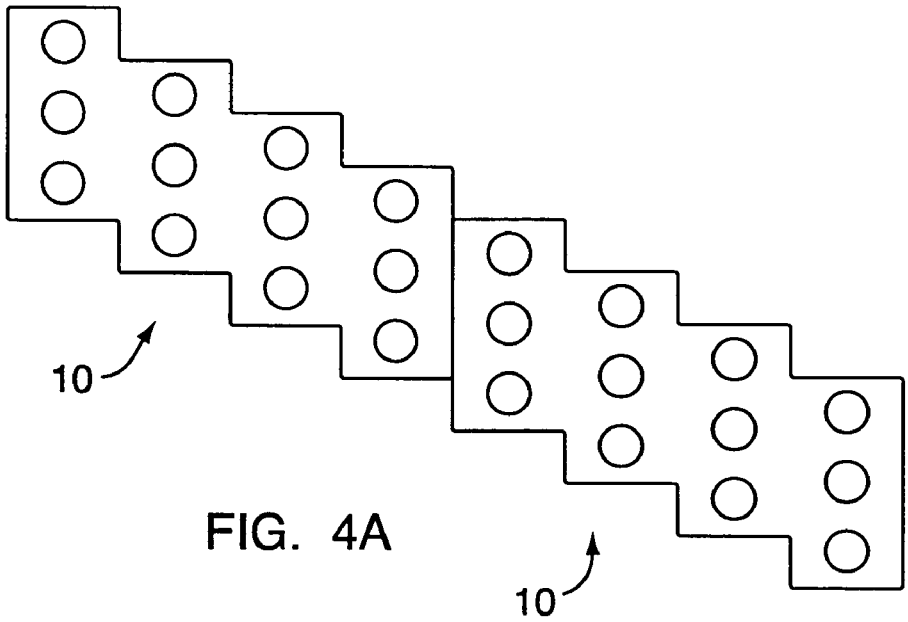
FIG. 4A is a top plan view schematically illustrating another overall shape of abutting together two modular display platforms.
Figure 4B:
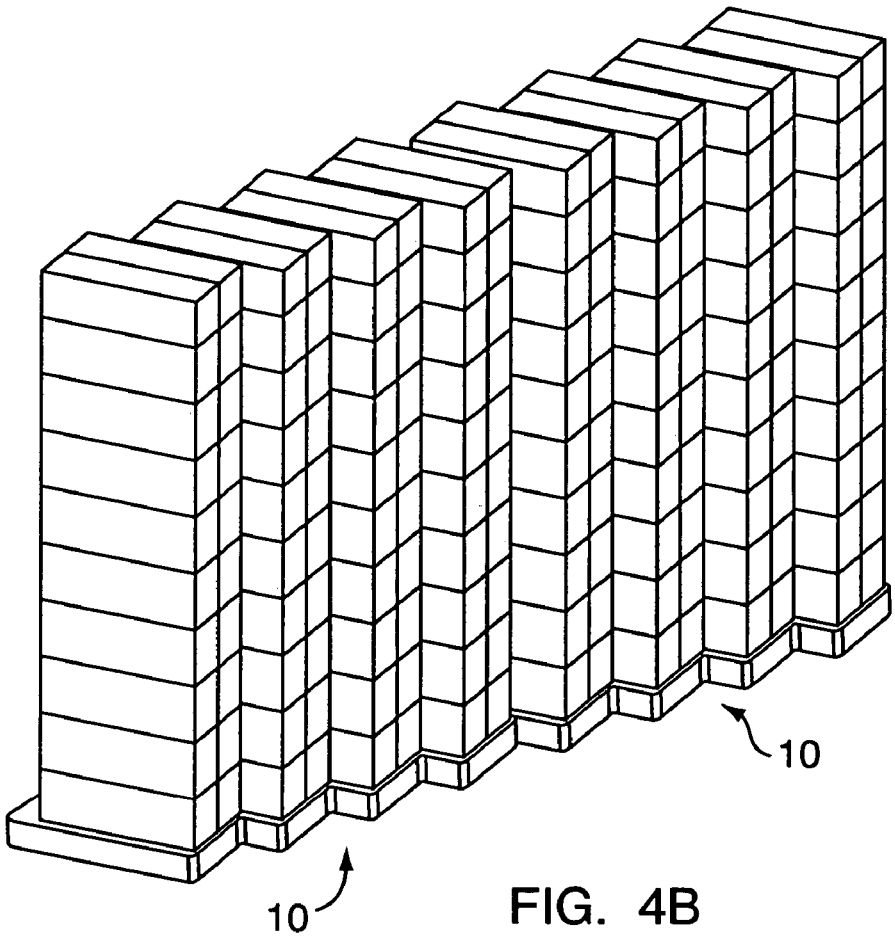
FIG. 4B is a perspective view of a visual display resulting from stacking boxes on the modular display platforms abutted together a shown in FIG. 4A.
Figure 5A:
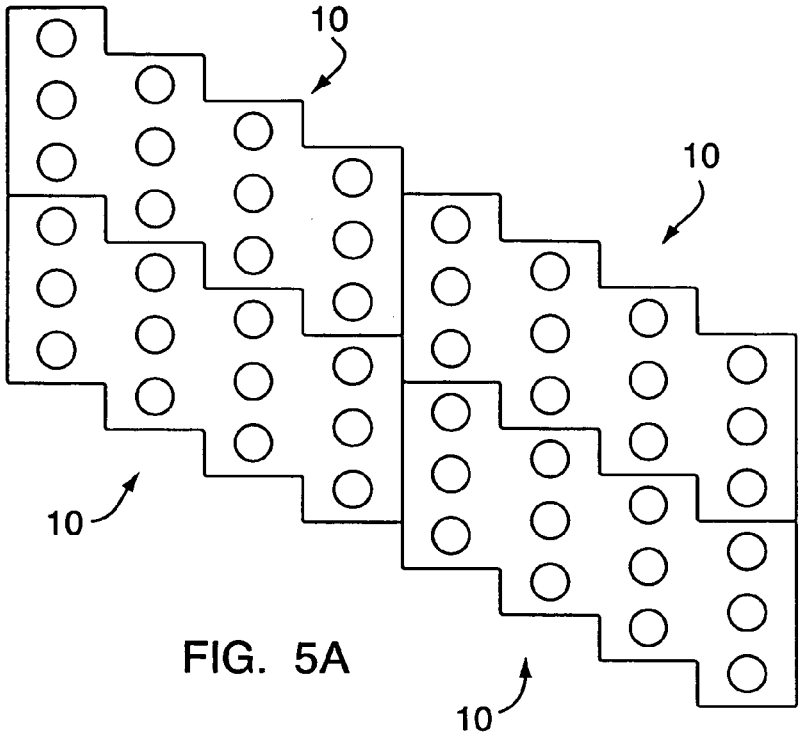
FIG. 5A is a top plan view schematically illustrating another overall shape of abutting together four modular display platforms.
Figure 5B:
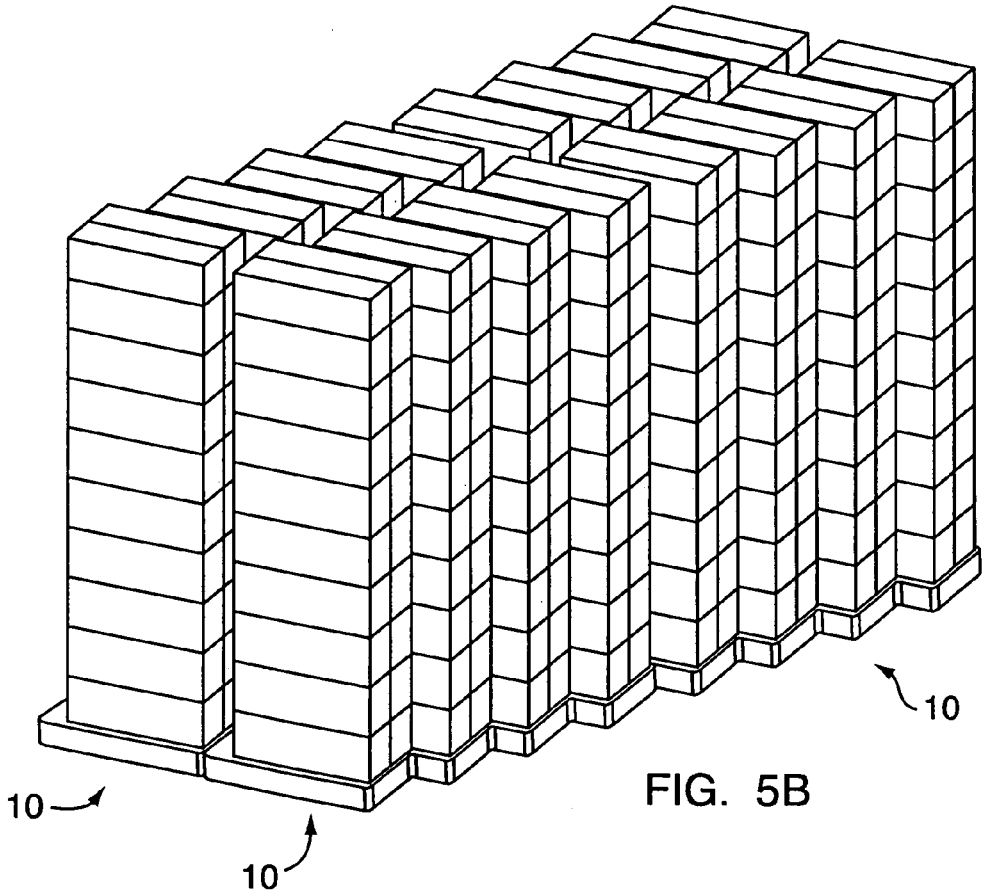
FIG. 5B is a perspective view of a visual display resulting from stacking boxes on the modular display platforms abutted together a shown in FIG. 5A.
Figure 6A:
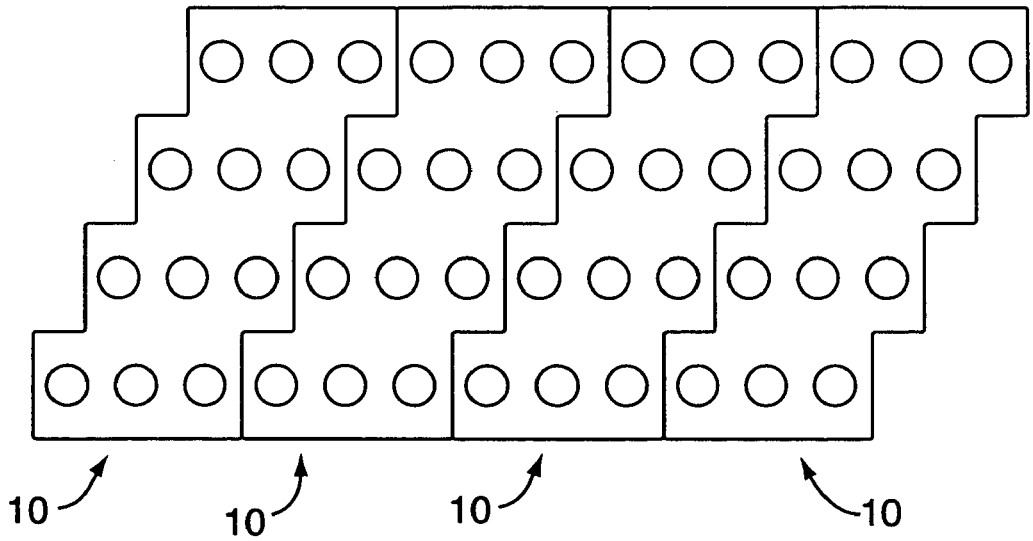
FIG. 6A is a top plan view schematically illustrating another overall shape of abutting together four modular display platforms.
Figure 6B:
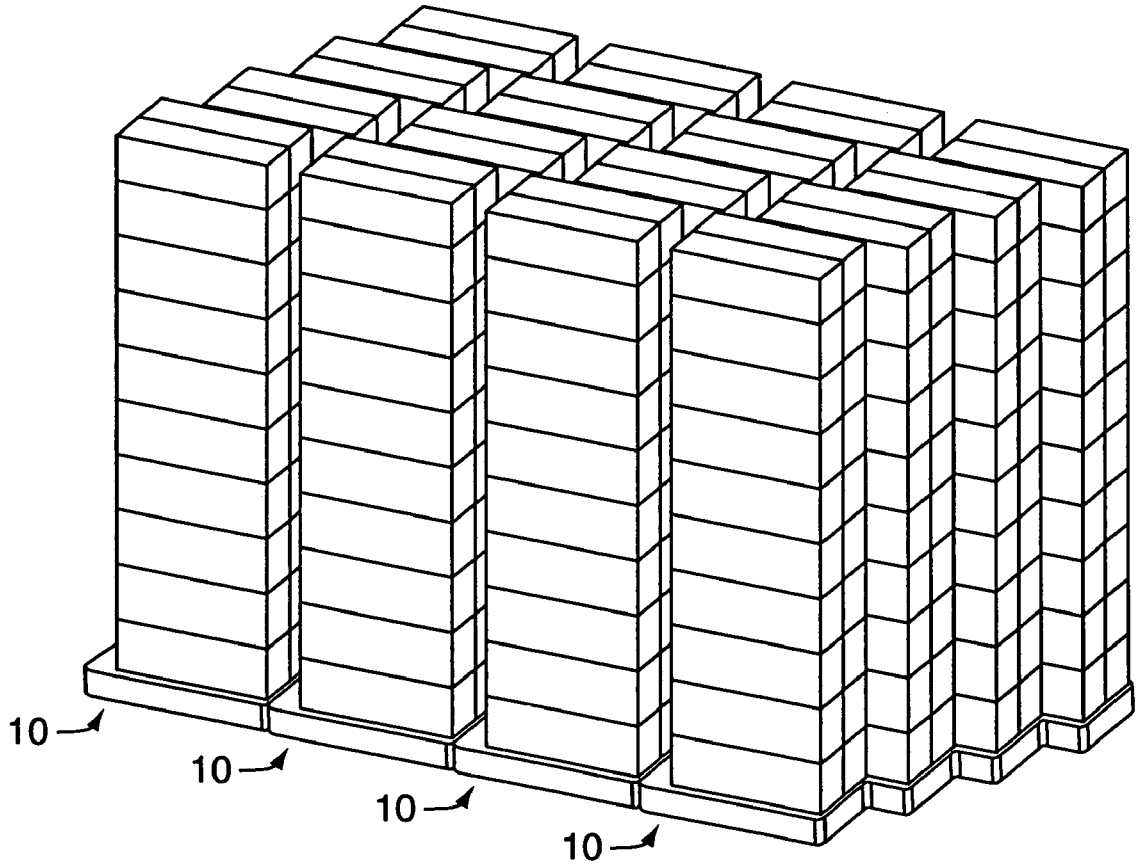
FIG. 6B is a perspective view of a visual display resulting from stacking boxes on the modular display platforms abutted together a shown in FIG. 6A.
Figure 7A:
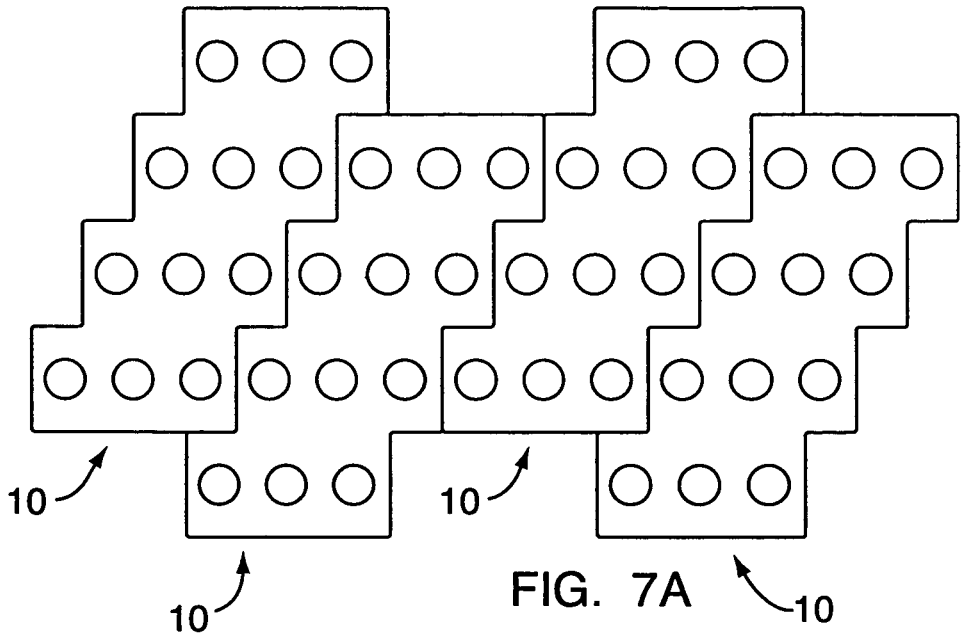
FIG. 7A is a top plan view schematically illustrating another overall shape of abutting together four modular display platforms.
Figure 7B:
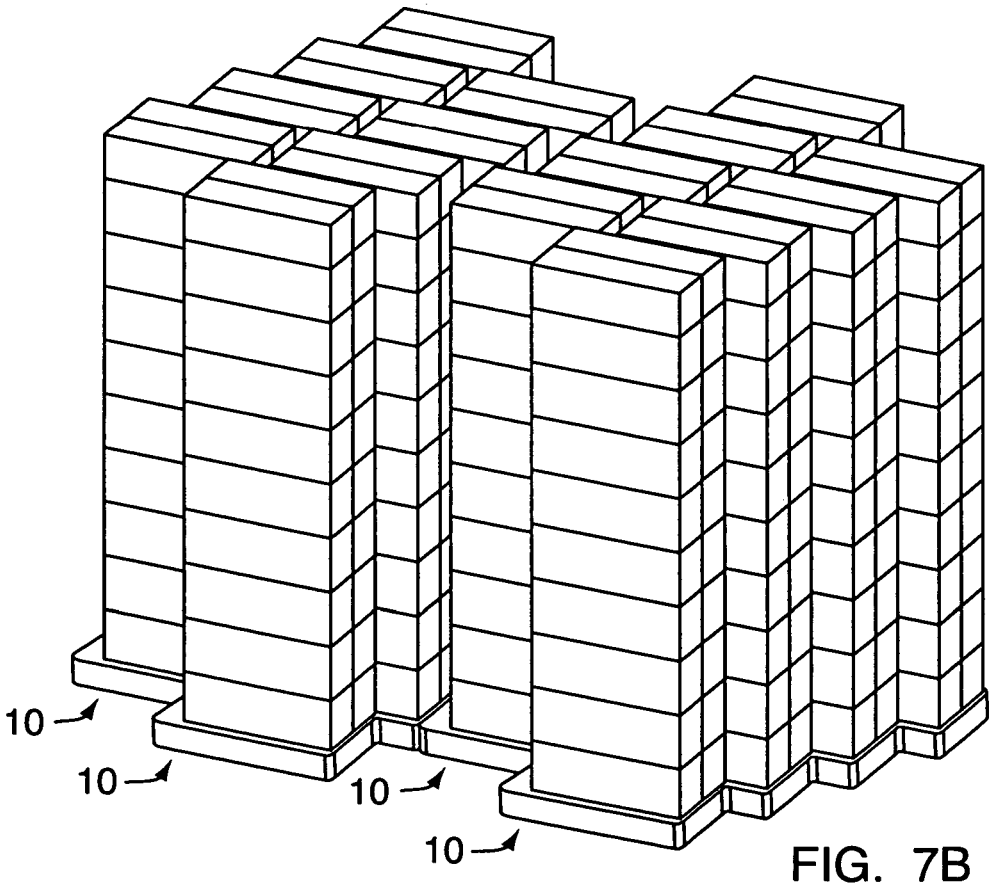
FIG. 7B is a perspective view of a visual display resulting from stacking boxes on the modular display platforms abutted together a shown in FIG. 7A.

Examples of different visually appealing patterns are illustrated. For example, as shown in FIGS. 2A and 2B, four platforms 10 are abutted generally one-behind-the-other. As shown in FIGS. 3A and 3B, two platforms 10 forming a first row are abutted end-to-end, and two additional platforms forming a second row are abutted end-to-end and interlocked behind the first row. As shown in FIGS. 4A and 4B, two platforms 10 are abutted end-to-end. As shown in FIGS. 5A and 5B, two platforms 10 forming a first row are abutted end-to-end, and two additional platforms forming a second row are abutted end-to-end and interlocked behind the first row in a different manner as was shown in FIGS. 3A and 3B. As shown in FIGS. 6A and 6B, four platforms 10 are abutted and interlocked generally one-behind-the-other in a different manner as was shown in FIGS. 2A and 2B. As shown in FIGS. 7A and 7B, four platforms 10 are abutted and interlocked generally one-behind-the-other in a yet different manner.

Figure 8:
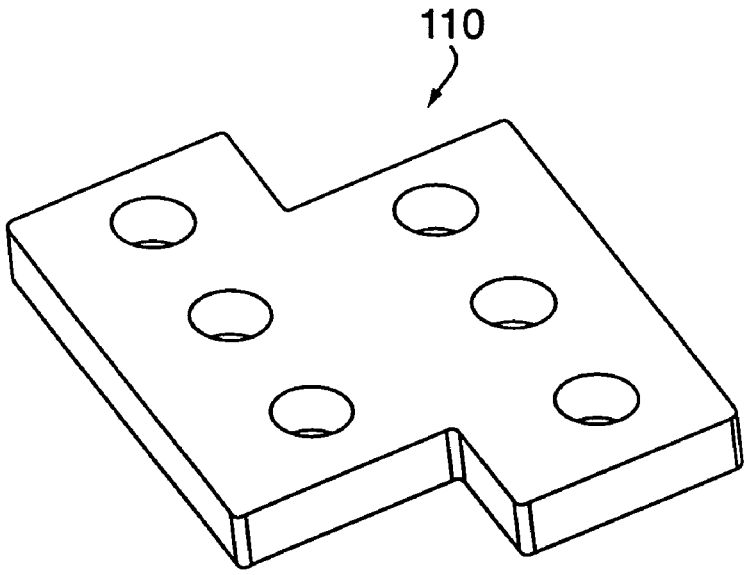
FIG. 8 is a top plan view of a two-section modular display platform embodying the present invention.
Figure 9:
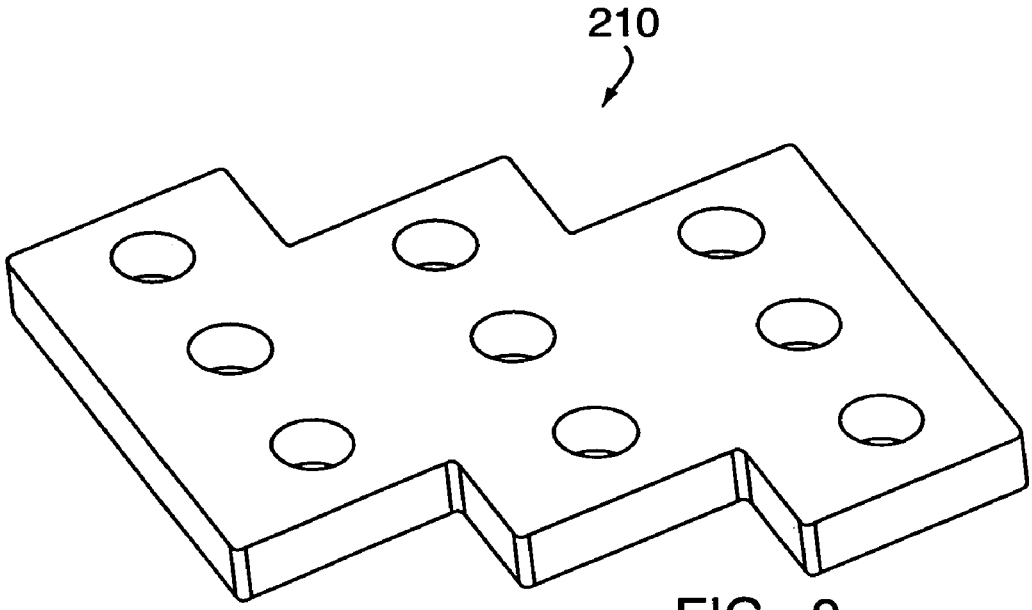
FIG. 9 is a top plan view of a three-section modular display platform embodying the present invention.

As will be recognized by those of ordinary skill in the pertinent art, numerous modifications and substitutions may be made to the above-described embodiment of the present invention without departing from the scope of the invention. For example, platforms having a number of sections other than the four-section platform 10 can be substituted or combined with a four-section platform. The number of sections can typically range from two to ten depending upon the available area for display. For example, a two-section platform 110 is shown in FIG. 8, and a three-section platform 210 is shown in FIG. 9. Moreover, the platforms can take different shapes such as mirror images of those illustrated. Accordingly, the preceding portion of this specification is to be taken in an illustrative, as opposed to a limiting sense.

What is claimed is:

1. A modular display platform comprising:

at least two sections of substantially the same shape, wherein each section is fixedly disposed next to at least one adjacent section in staggered relationship such that a perimeter of the at least two sections cooperate to form a stepped pattern for facilitating the abutting and interlocking of additional platforms at the perimeter, the at least two sections cooperating to include:

a support surface for products disposed thereon extending generally over an area bounded by the perimeter;

a sidewall disposed generally along at least a portion of the perimeter and extending in a direction generally transverse to that of the support surface from a proximal end of the sidewall adjacent to the support surface to a distal end of the sidewall for engaging an external mounting surface, the support surface and the sidewall cooperating to define a recess; and at least one standoff disposed within the recess and having a surface extending in a direction generally parallel to that of the sidewall from a proximal end of the standoff adjacent to the support surface to a distal end of the standoff for engaging the external surface in order to strengthen the support surface at locations inwardly of the perimeter.

2. A modular display platform as defined in claim 1, wherein three standoffs are associated with each of the at least two sections.

3. A modular display platform as defined in claim 1, wherein the surface of the at least one standoff defines a generally hollow interior, and the support surface defines an opening exposing the hollow interior of the at least one standoff.

4. A modular display platform as defined in claim 3, wherein the at least one standoff further includes a floor disposed at the distal end of the at least one standoff and extending substantially over an area bounded by the surface of the at least one standoff.

5. A modular display platform as defined in claim 4, wherein the floor defines a hole extending therethrough.

6. A modular display platform as defined in claim 1, wherein the surface of the at least one standoff is generally cylindrical.

7. A modular display platform as defined in claim 1, wherein a portion of the support surface corresponding to each of the at least two sections is generally rectangular.

8. A modular display platform as defined in claim 1, wherein the at least two sections form a unitary structure.

9. A modular display platform as defined in claim 1, wherein the at least two sections include three sections.

10. A modular display platform as defined in claim 1, wherein the at least two sections include four sections.

11. A modular display platform as defined in claim 1, wherein the at least two sections are fabricated from a material including high density polyethylene.

12. A modular display platform as defined in claim 1, wherein the at least two sections are fabricated from a material including high density polyethylene injection molded plastic.

13. A modular display platform as defined In claim 12, wherein the at least two sections are integrally molded with one another.

14. A modular display platform as defined in claim 1, wherein each of the at least two sections approximately conforms to the shape of a rectangular box for packaging cans of beverages.

15. A modular display platform as defined in claim 1, wherein each of the at least two sections is rectangular and has a width of about 10 inches, a length of about 19 inches, and a height of about 3 inches.

16. A modular display platform as defined in claim 15, wherein each of the at least two sections is offset from an adjacent segment by about 4.75 inches in a direction along a length of the sections.

17. A modular display platform as defined in claim 1, wherein the sidewall is disposed substantially along the entire perimeter.

18. A modular display platform comprising:

at least two sections each having a generally rectangular shape, wherein each section is fixedly disposed next to at least one adjacent section in staggered relationship such that a perimeter of the at least two sections cooperate to form a stepped pattern for facilitating the abutting and interlocking of additional platforms at the perimeter, the at least two sections cooperating to include:

a support surface for products disposed thereon extending generally over an area bounded by the perimeter;

a sidewall disposed generally along the perimeter and extending in a direction generally transverse to that of the support surface from a proximal end of the sidewall adjacent to the support surface to a distal end of the sidewall for engaging an external mounting surface, the support surface and the sidewall cooperating to define a recess; and at least one standoff disposed within the recess and having a generally cylindrical surface extending in a direction generally parallel to that of the sidewall from a proximal end of the standoff adjacent to the support surface to a distal end of the standoff for engaging the external surface in order to strengthen the support surface at locations inwardly of the perimeter.

19. A modular display platform comprising:

at least two sections fabricated from a material inducing high density polyethylene, and integrally molded with one another to form a unitary structure, each of the at least two sections having a generally rectangular shape, wherein each section is fixedly disposed next to at least one adjacent section in staggered relationship such that a perimeter of the at least two sections cooperate to form a stepped pattern for facilitating the abutting and interlocking of additional platforms at the perimeter, the at least two sections cooperating to include:

a support surface for products disposed thereon extending generally over an area bounded by the perimeter;

a sidewall disposed generally along the perimeter and extending in a direction generally transverse to that of the support surface from a proximal end of the sidewall adjacent to the support surface to a distal end of the sidewall for engaging an external mounting surface, the support surface and the sidewall cooperating to define a recess; and at least one standoff disposed within the recess and having a generally cylindrical surface extending in a direction generally parallel to that of the sidewall from a proximal end of the standoff adjacent to the support surface to a distal end of the standoff for engaging the external surface in order to strengthen the support surface at locations inwardly of the perimeter.

* * * * *